United States Patent [19]

De Gouville et al.

[11] Patent Number: 4,953,534

[45] Date of Patent: Sep. 4, 1990

[54] GAS BURNER ASSEMBLY OF EXTRA FLAT TYPE

[75] Inventors: Jean-Bernard L. De Gouville, Joue-Les-Tours; Bernard Dane, Montbazon, both of France

[73] Assignee: Sourdillon-Airindex, France

[21] Appl. No.: 466,614

[22] Filed: Jan. 17, 1990

[30] Foreign Application Priority Data

Jan. 20, 1989 [FR] France ..... 89 00693

[51] Int. Cl.[5] ..... F24C 3/00

[52] U.S. Cl. ..... 126/39 H; 431/354; 431/266; 239/558; 239/559; 239/567

[58] Field of Search ..... 431/354, 264, 266; 126/39 R, 39 H; 239/558, 559, 567

[56] References Cited

U.S. PATENT DOCUMENTS 4,762,530 8/1988 Koziol ..... 431/354

*Primary Examiner*—Carroll B. Dority

*Attorney, Agent, or Firm*—Larson and Taylor

[57] ABSTRACT

An extra flat type gas burner assembly is provided, comprising an annular venturi (17), a tubular member (11) fast with the burner body (1) extending vertically thereunder to cover the injector (5) and position the latter coaxially at the intake (15) of the gas-air mixture in the burner body, whereas the injector (5) is supported freely by a structural element (18).

8 Claims, 1 Drawing Sheet

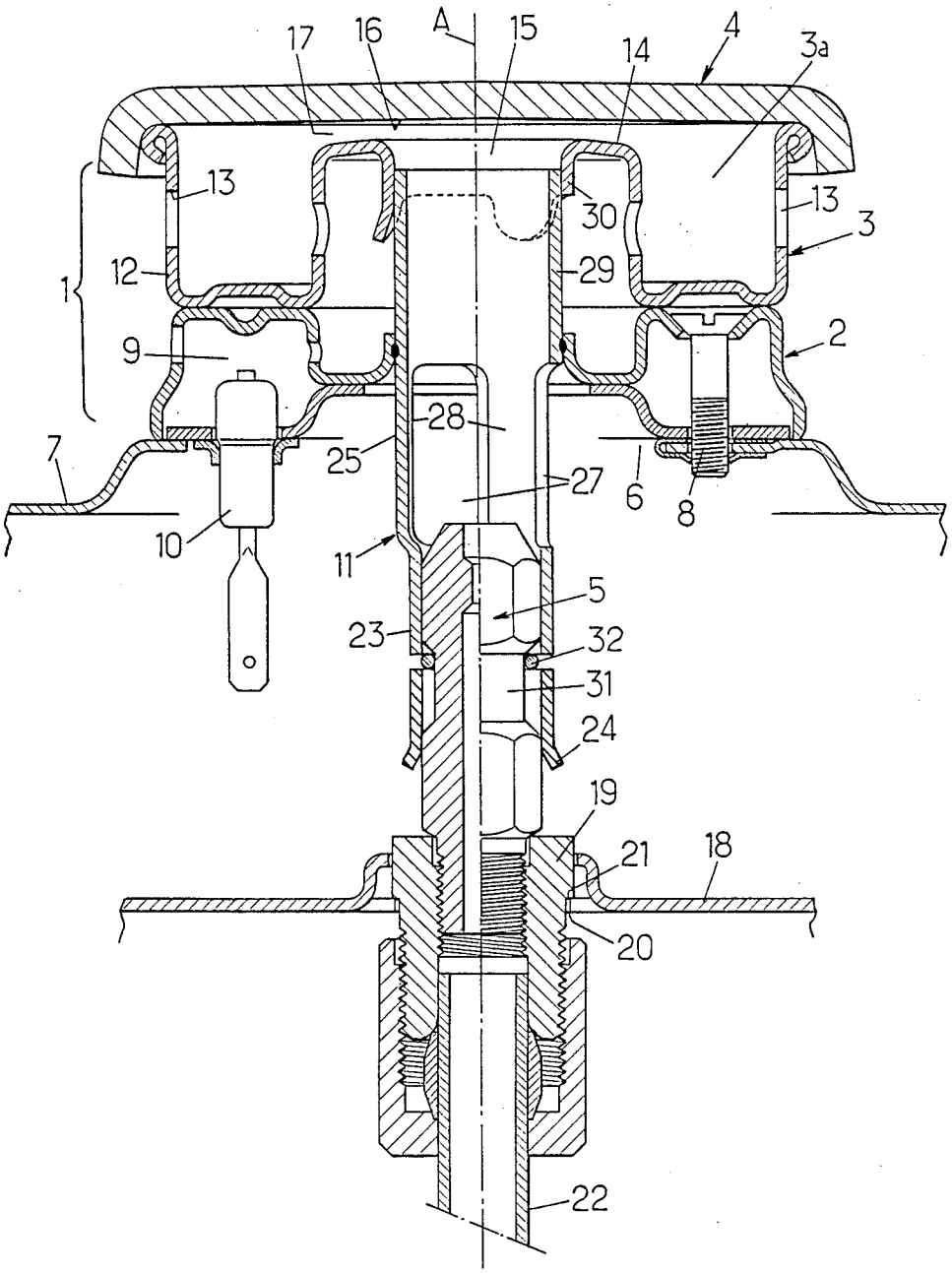
A
17
16
15
14
4
3a
13
13
30
3
12
29
1
9
2
28
7
25
27
6
8
10
11
5
23
32
31
24
19
21
18
20
22

GAS BURNER ASSEMBLY OF EXTRA FLAT TYPE

The present invention relates to improvements to gas burner assemblies of the extra flat type for gas appliances, particularly household appliances, which comprise:

a burner body comprising an annular expansion chamber whose external sidewall is formed with a multitude of flame passages spaced apart circumferentially, this burner body having a central plate with a central orifice open downwards for the intake of an gas-air mixture into the expansion chamber, this burner body being further adapted to be fixed in an approximately axial position on the periphery of an opening formed in a top plate of the gas appliance, a cap covering said burner body and closing said expansion chamber, the facing zones of the internal face of the cap and of the upper face of the central plate diverging radially away from each other outwardly so as to form a diffuser or annular venturi, and a gas injector connected to a gas intake tube and disposed vertically and axially under said gas-air mixture intake orifice of the burner body and at a distance therefrom, said injector being adapted to be supported by a structural element of the gas appliance situated below said top plate.

The purpose of the invention is essentially to simplify the assembly of gas appliances equipped with burners of the above type, while obtaining, by simple technical means, as perfect a coaxiality as possible of the gas injector and the gas-air mixture intake orifice of the burner body; in other words, the purpose of the invention is to reduce the assembly cost of gas appliances while keeping the excellent functional characteristics, even improving these characteristics.

For this, a burner arranged in accordance with the invention is characterized in that it comprises a tubular member or similar extending vertically and axially between the gas-air mixture intake orifice of the burner body and the injector; in that this tubular member has a first end portion which cooperates closely with the external contour of the injector, an intermediate portion extending between the injector and the burner body and having at least one aperture formed in its wall for the intake of primary air, and a second end portion opposite the first one which cooperates closely with the contour of the gas-air mixture intake orifice of the burner body; and in that the injector rests freely in an overdimensioned housing of the structural element which supports it.

With this arrangement, the injector may simply rest on the structural element without being fixed or secured thereto. The advantage thus obtained is considerable, for it maintains the facility of independent and easier assembly of the burner body and of the injector (the first on the top plate and the second on the structural element). Mounting of the injector on the structural element which supports it may then be achieved without having to bother about any positioning accuracy; the structural element which carries the injector and the top plate which carries the burner body do not have to be positioned mutually in a vertical direction with great accuracy either; on the other hand, at the time of positioning the burner body (the injector having been previously disposed on the structural element), the presence of the tubular member brings the injector into a position which is perfectly coaxial with respect to the gas-air mixture intake orifice of the burner body, whatever the position finally adopted by the burner body with respect to the opening of the top plate on which it is fixed, and here again without need to worry about any precise positioning during assembly of the burner body; the correct coaxial positioning of the injector and of the burner body is obtained automatically, with all the desired accuracy, by using technologically simple and inexpensive means.

In a perferred embodiment, the tubular member or similar is fast with the burner body or a component part thereof and projects vertically thereunder, and its first end portion is adapted for closely mating with the external contour of the injector with the possibility of longitudinal sliding therealong; in particular, in the case where the burner body is formed of shaped and welded metal sheet structural elements, the second end portion of the tubular member may be welded to the burner body or to a component part thereof.

It is further advantageous for removable axial securing means to connect the injector and the first end portion of the tubular member axially together, with a possibility of relative longitudinal movement. In order to obtain a simple construction, it is advantageous for the connecting means to comprise an annular groove having a longitudinal extent and at least one projection engaged in this groove for interlocking the tubular member with the injector. In one example of easy mounting, the groove is formed in the external surface of the injector and the projection is a circlip or similar fast with the first end portion of the burner body. So that a sufficient amount of primary air may be mixed with the gas while conferring sufficient mechanical strength on the tubular member, it is desirable for the intermediate portion of the tubular member to be provided with several apertures spaced apart circumferentially and separated from each other by pillars joining together the first and second end portions.

In a preferred embodiment, this extra flat type burner is characterized in that the burner body comprises an annular base which is fixed to the top plate and a pot defining an annular expansion chamber which rests removably on the base; in that the tubular member is fast with the base, the second end portion of this tubular member extending beyond the base and projecting thereabove; and in that the removable pot is fitted on the upper end of the tubular member and is retained by the latter in a coaxial position.

The invention will be better understood from the following detailed description of a certain preferred embodiment, given solely by way of example, and shown in a vertical diametrical section in the single figure of the accompanying drawings.

The extra flat burner assembly shown in the single figure comprises generally a burner body designated as a whole by the reference 1, which is formed essentially of a base 2 and a pot 3 defining an expansion chamber 3a for the gas; a cap 4 covers pot 3. Finally, a gas injector 5 is disposed vertically under the burner body and at a distance therefrom.

Base 2 is an annular part, for example formed by assembling together several welded metal sheet parts, which is fixed to the periphery of an opening 6 formed in the top plate 7 of the gas appliance. Fixing is provided by any appropriate means, for example by screws 8. This base may be adapted to define an auxiliary chamber 9 in which an electric electrode 10 is housed for automatic ignition of the burner.

In the central recessed portion of the base is engaged a tubular member 11 which is secured (for example welded) to base 2 and which will be more particularly discussed hereafter.

On base 2 rests the pot 3 which is also formed from stamped metal sheet. The external wall 12 of pot 3 is formed with a multitude of holes 13 spaced apart circumferentially for the passage of the flames. The central portion of pot 3, situated in the center of the annular expansion chamber 3*a*, is adapted in the form of a plate 14 in the center of which opens an axial orifice 15 for intake of the gas-air mixture. Auxiliary connections place the expansion chamber 3*a* in connection with the auxiliary chamber 9.

Cap 4 rests on the annular edge of the external wall 12 of pot 3 so that its internal face 16 remains spaced away from plate 14. In addition, the facing portions of the internal face 16 of cap 4 and the annular surface of the plate diverge from each other radially outwardly so as to form an annular venturi 17.

Under the burner body 1, injector 5 is freely supported by a structural element 18 of the gas appliance; this structural element 18 is therefore normally fixed with respect to the top plate 7. More specifically, injector 5 is fast with an injector holder 19, which is engaged in an overdimensioned opening 20 in the structural element 18; the injector holder 19 has an annular shoulder 21 which bears on the edge of opening 20. The injector holder 19 is therefore simply supported by the structural element 18 and may move transversely, even tip. At the lower end of the injector is connected, by any appropriate means, a tube 22 for the intake of the gas, which is relatively flexible.

Turning now more specifically to the tubular member 11, it comprises essentially three successive longitudinal portions.

A first portion situated towards its lower end, or first end portion 23, has a cylindrical tubular shape of revolution and closely mates with the contour (polygonal in the example shown) of injector 5. The clearance between injector 5 and the first end portion 23 is minimum but however allows free longitudinal sliding of this tubular portion on the injector, as will be described below. The free end of this tubular portion 23 is bell-mouthed at 24 for facilitating fitting thereof on the injector (which is itself provided with a tapered end).

A second portion or intermediate portion 25 of the tubular member 11 extends above the first portion 23 as far as the burner body 1. In the example shown, this second portion has a cylindrical tubular shape of revolution. Its wall is formed with a plurality (three in the example shown) of aperturess 27 through which penetrates the primary air for mixing with the gas leaving the injector. The total area of these apertures is as large as possible, and apertures 27 are separated from each other by the material forming pillars 28 which provide the mechanical continuity between the top and bottom zones of the tubular member.

Finally, a third portion or top end portion 29 or else second end portion extends above said intermediate portion 25 as far as orifice 15 with whose wall it cooperates. More precisely, the wall defining orifice 15 is bent downwards so as to form a skirt 30 which slidingly grips the upper end of the tubular member 11. The tubular member 11 is fixed, particularly by welding, with the base 2 approximately in a zone between said intermediate 25 and top 29 portions.

Of course, other configurations may be adopted depending on the circumstances and particularly depending on the structure of the burner body. In particular, in the case of a one-piece burner block made from moulded metal, the tubular member 11 may be fixed (e.g. by screwing) to the lower face of the burner body. In addition, the form of the intermediate portion 25 is not critical and may be adapted to different requirements (e.g. a general tapered shape).

Mechanical connection of the tubular member 11 and injector 5 may be provided. For this, an annular groove 31 is formed in the external surface of injector 5, in which groove is engaged a gripping element 32 such as a circlip which is fast with the first end portion 23 of the tubular member 11. In the context considered of an extra flat type gas burner with annular venturi, because the distance separating the orifice of injector 5 and the neck of the venturi 17 is not critical, groove 31 may have a certain longitudinal extent (e.g. 5 or 6 mm) corresponding to tolerances for assembling injector 5 on the structural element 18 which are not severe.

It will be noted that, because of the arrangement which has just been described, the injector is simply supported by the structural element 18, without being fixed thereto and that it may therefore effect transverse movements, even have a certain slant with respect to this structural element. Under these conditions, at the time of assembly, the injector is disposed previously on the structural element 18 then the tubular member 11 is fitted on injector 5 at the time when base 2 is presented facing opening 6 for fixing to the edges thereof. Thus it is the tubular member 11 which then holds the injector in the position of required verticality and coaxiality (axis A) without it being necessary to use complex and expensive solutions for mutual positioning on respective support parts. Once base 2 is fixed in position on the top plate 7, pot 3 is laid on base 2 with the gas-air mixture intake orifice 15 fitted on the upper end of the tubular member 11; pot 3 is then in its turn positioned appropriately with perfect coaxiality with respect to injector 5. In other words, the tubular member 11 plays the role of coaxial positioning guide for injector 5 and for orifice 15 thus providing maximum efficiency of the burner.

As is evident and as it follows already moreover from what has gone before, the invention is in no wise limited to those of its modes of application and embodiments which have been more particularly considered; it embraces, on the contrary, all variants thereof.

What is claimed:

1. Gas burner of the extra flat type for gas appliances, particularly household appliances, which comprises:

a burner body (1) comprising an annular expansion chamber (3*a*) whose external sidewall (12) is formed with a multitude of flame passages (13) spaced apart circumferentially, having a central orifice (15) open downwards for the intake of a gas-air mixture into the expansion chamber, this burner body being further adapted to be fixed in an approximately axial position on the periphery of an opening (6) formed in a top plate (7) of the gas appliance, a cap (4) covering said burner body (1) and closing said expansion chamber (3*a*), the facing zones of the internal face (16) of the cap (4) and of the upper face of a central plate (14) diverging radially away from each other outwardly so as to form a diffuser or annular venturi (17), and a gas injector (5) connected to a gas intake tube (22) and disposed vertically and axially under said gas-air mixture intake orifice (15) of the burner body and at a distance therefrom, said injector being adapted to be supported by a structural element (18) of the gas appliance situated below said top plate (7), characterized, in that it comprises a tubular member or similar (11) extending vertically and axially between the gas-air mixture intake orifice (15) of the burner body and the injector (5);

in that this tubular member (11) has a first end portion (23) which cooperates closely with the external contour of the injector(5), an intermediate portion (25) extending between the injector and the burner body and having at least one aperture (27) formed in its wall for the intake of primary air, and a second end portion (29) opposite the first one which cooperates closely with the contour of the gas-air mixture intake orifice (15) of the burner body; and in that the injector rests freely in an overdimensioned housing (20) of the structural element (18) which supports it;

whereby the injector (5) already positioned in its housing in the structural element is automatically positioned by said tubular member, coaxially with the gas-air mixture intake orifice of the burner body, during positioning of said burner body on the top plate.

2. Gas burner according to claim 1, characterized in that said tubular member or similar is fast with the burner body or a component part thereof and projects vertically thereunder, and in that its first end portion (23) is adapted for closely mating with the external contour of the injector (5) with the possibility of longitudinal sliding therealong.

3. Gas burner according to claim 2, wherein the burner body is formed of structural elements made from shaped and welded metal sheet, characterized in that the tubular member is welded to the burner body by its second end portion (29).

4. Gas burner according to claim 2, characterized in that removable axial securing means connect the injector (5) and the first end portion (23) of the tubular member axially together, with a possibility of relative longitudinal movement.

5. Gas burner according to claim 4, characterized in that the axial securing means comprise an annular groove (31) having a longitudinal extent and at least one projection (32) engaged in this groove.

6. Gas burner according to claim 5, characterized in that the groove (31) is formed in the external surface of the injector (5) and in that the projection (35) is a circlip or similar fast with the first end portion (23) of the tubular member (11).

7. Gas burner according to claim 1, characterized in that the intermediate portion (25) of the tubular member has several apertures (27) spaced apart circumferentially and separated from each other by pillars (28) joining the first and second end tubular members (23, 29) together.

8. Gas burner of extra flat type according to claim 2, characterized in that the burner body (1) has an annular base (2) which is fixed to a top plate (7) and a pot (3), defining the annular expansion chamber (3*a*), which rests removable on the base, in that the tubular member (11) is fast with the base (2), the second end portion (29) of this tubular member extending beyond the base (2), and projecting thereabove, and in that the removable pot (3) is fitted on the upper end of the tubular member (11) to be retained thereby in an axial position.

* * * * *